US009323222B2

(12) United States Patent
Stranczl

(10) Patent No.: US 9,323,222 B2
(45) Date of Patent: Apr. 26, 2016

(54) FLEXIBLE TIMEPIECE GUIDANCE

(71) Applicant: Nivarox-FAR S.A., Le Locle (CH)

(72) Inventor: Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/795,448

(22) Filed: Jul. 9, 2015

(65) Prior Publication Data

US 2016/0011566 A1 Jan. 14, 2016

(30) Foreign Application Priority Data

Jul. 14, 2014 (EP) ..... 14176918

(51) Int. Cl.
*G04B 17/04* (2006.01)
*G04B 15/14* (2006.01)

(52) U.S. Cl.
CPC ..... *G04B 15/14* (2013.01); *G04B 17/04* (2013.01)

(58) Field of Classification Search
CPC ..... Y10T 29/4957; Y10T 29/49787; G04B 17/08; G04B 17/04; G04B 15/14; G04B 17/00
See application file for complete search history.

(56) References Cited

U.S. PATENT DOCUMENTS 3,318,087 A 5/1967 Favre
3,352,000 A 11/1967 Altenburger
3,448,304 A * 6/1969 Fritz ..... G04B 17/10 310/15
3,635,013 A * 1/1972 Bertsch ..... G04C 3/04 368/169
9,201,399 B2 * 12/2015 Cordier ..... G04B 17/10

FOREIGN PATENT DOCUMENTS

EP 2 273 323 A2 1/2011
FR 1 502 775 11/1967

OTHER PUBLICATIONS

European Search Report issued Jun. 2, 2015 in European Application 14176918.2, filed on Jul. 14, 2014 (with English translation).

* cited by examiner

*Primary Examiner* — Sean Kayes

(74) *Attorney, Agent, or Firm* — Oblon, McClelland, Maier & Neustadt, L.L.P.

(57) ABSTRACT

A device for elastic guidance in rotation for a timepiece mechanism allowing rotation of one element relative to another element about an axis of rotation Z defining an axial direction, including construction blades, each construction blade includes an assembly fixing part including a body and a functional part extending from the body as far as one end, the assembly fixing part and the functional part being separated by at least one slot in at least two extensions which are elastically connected and extend in a radial direction transverse to the axial direction, and anchorage zones which are disposed at opposite axial ends of the flexible guidance device, and configured to be fixed to the elements.

17 Claims, 5 Drawing Sheets

FLEXIBLE TIMEPIECE GUIDANCE

This application claims priority from European Patent Application No. 14176918.2 filed 14 Jul. 2014, the entire disclosure of which is incorporated herein by reference.

FIELD OF THE INVENTION

The present invention relates to flexible timepiece guidance, in particular a device for elastic guidance in rotation allowing pivoting of an element of a watch movement about an axis of rotation.

BACKGROUND OF THE INVENTION

In timepiece movements, there are several components which pivot about an axis of rotation, such as the pallets, or the balance wheel of an escapement device. Some of these pivoting elements are coupled to a spring, amongst other oscillating elements, such as the balance wheel of the escapement device. In mechanical watches, it is advantageous to have a high-output movement in order to increase the power reserve. The loss of energy due to friction in the bearings of the pivoting parts is one of the greatest sources of energy loss. The quality factor of the parts is also an important consideration for mechanical watches.

In order to reduce these losses, it is known to propose flexible guidance in rotation oscillating about a pivot without bearings, such as described in the patent application EP 2 273 323. This flexible guidance comprises silicon components etched in a silicon wafer in order to produce a monolithic structure comprising a frame, elastic blades and a central attachment body. In order to obtain a sufficiently robust frame and a sufficiently high amplitude of rotation for the oscillator function, a plurality of these monolithic structures are stacked one on the other. One of the disadvantages of this structure is that the manufacturing cost of the three-dimensional monolithic elements is high. Furthermore, the spring blades extending in the radial direction are delicate and do not have an optimum shape for the desired function, i.e. great flexibility in the plane orthogonal to the axis of rotation and great rigidity in the direction of the axis of rotation. In fact, since the blades are etched in a silicon wafer in the direction orthogonal to the surface of the wafer, control of the thickness of the blade is difficult to control with precision, which has a negative influence on performance and in particular well-determined properties of flexibility, robustness and elasticity parameters.

SUMMARY OF THE INVENTION

One object of the invention is to provide a device for elastic guidance in rotation which is compact and economical to manufacture and has good performance in use.

It is advantageous, for certain functions, to provide a device for elastic guidance which allows a large angle of rotation.

It is advantageous to provide a method for manufacturing a device for elastic guidance in rotation which makes it possible to produce complex structures, according to the application, but which is economical to implement.

It is advantageous to provide a device for elastic guidance with very low consumption of energy in use.

It is advantageous to provide a robust device for elastic guidance.

The objects of the invention are achieved by a device for elastic guidance in rotation for a timepiece mechanism according to claim 1. The dependent claims describe advantageous aspects of the invention.

In the present case, a device for elastic guidance in rotation for a timepiece mechanism is described, which allows rotation of one element relative to another element about an axis of rotation defining an axial direction.

The device comprises construction blades, each construction blade comprises an assembly fixing part comprising a body and a functional part extending from the body as far as one end, the assembly fixing part and the functional part being separated by at least one slot in at least two extensions which are elastically connected and extend in a radial direction, said direction transverse to the axial direction, said device comprising furthermore anchorage zones which are disposed at opposite axial ends of the flexible guidance device, the anchorage zones being configured to be fixed to said elements. The construction blades are formed from a thin sheet of material, in particular crystalline material, defining a main plane, the construction blades being orientated such that the axis of rotation of the flexible guidance is parallel to the main plane of the construction blades.

In one embodiment, the thin wafer comprises two layers of equal or different thicknesses, welded or glued together, the construction blade having parts with a thickness corresponding to the thickness of one of the layers and parts with a thickness corresponding to the thickness of the two layers.

In one embodiment, the assembly fixing part of each of the construction blades comprises a cavity or an assembly recess and an assembly extension which intersect and which fit together according to a radial direction in order to be locked together.

In one embodiment, the body represents a central part of the device encompassing an axis of rotation of the device.

In one embodiment, the body of at least one of the construction blades comprises an assembly cavity configured for the insertion, according to a radial direction transverse to the axial direction, of a part of the other construction blade such that the assembly fixing part of the construction blades intersect.

In one embodiment, one of the construction blades includes a slot forming the assembly cavity, the functional part of the other blade being inserted in the slot until the body of the latter abuts against the body of the former.

Advantageously, each construction blade can be formed by deposition and/or etching processes according to an essentially bi-dimensional process.

In one embodiment, the construction blades are made of a material based on silicon. In one embodiment, the construction blades can for example be formed by a wafer cut out from a block of monocrystalline silicon.

In other embodiments, the construction blades can be made of Ni, NiP, amorphous metal or be formed by an electroforming process of the LIGA type.

The construction blades can also comprise sacrificial structures which assist assembly.

In one embodiment, each construction blade comprises a functional part extending in a radial direction on both sides of the body, this body forming a central part for rotation relative to the ends of the blades.

In one embodiment, the ends of the blades are free and floating.

In one embodiment, the device can advantageously be configured as a spring, and simultaneously as a support, for an oscillator or an element pivoting about the axis of rotation, without requiring another pivot or support for the pivoting element.

In one embodiment, each of the construction blades comprises only one functional part which extends from the assembly fixing part, forming for example a configuration essentially in a "V".

In one embodiment, the assembly fixing part of each of the construction blades comprises an assembly cavity and an assembly extension which intersect and which fit together in a radial direction in order to be locked together.

In one embodiment, the construction blades include a plurality of slots spaced in the axial direction in order to form a plurality of functional extensions which have elastic portions.

In one advantageous embodiment, each construction blade forms a monolithic structure.

In one advantageous embodiment, the device comprises only two monolithic construction blades.

BRIEF DESCRIPTION OF THE DRAWINGS

Other aims and advantageous aspects of the invention will appear upon reading the claims and also the detailed description of embodiments hereafter, and annexed drawings, in which:

DETAILED DESCRIPTION OF THE INVENTION

Figure 1A:
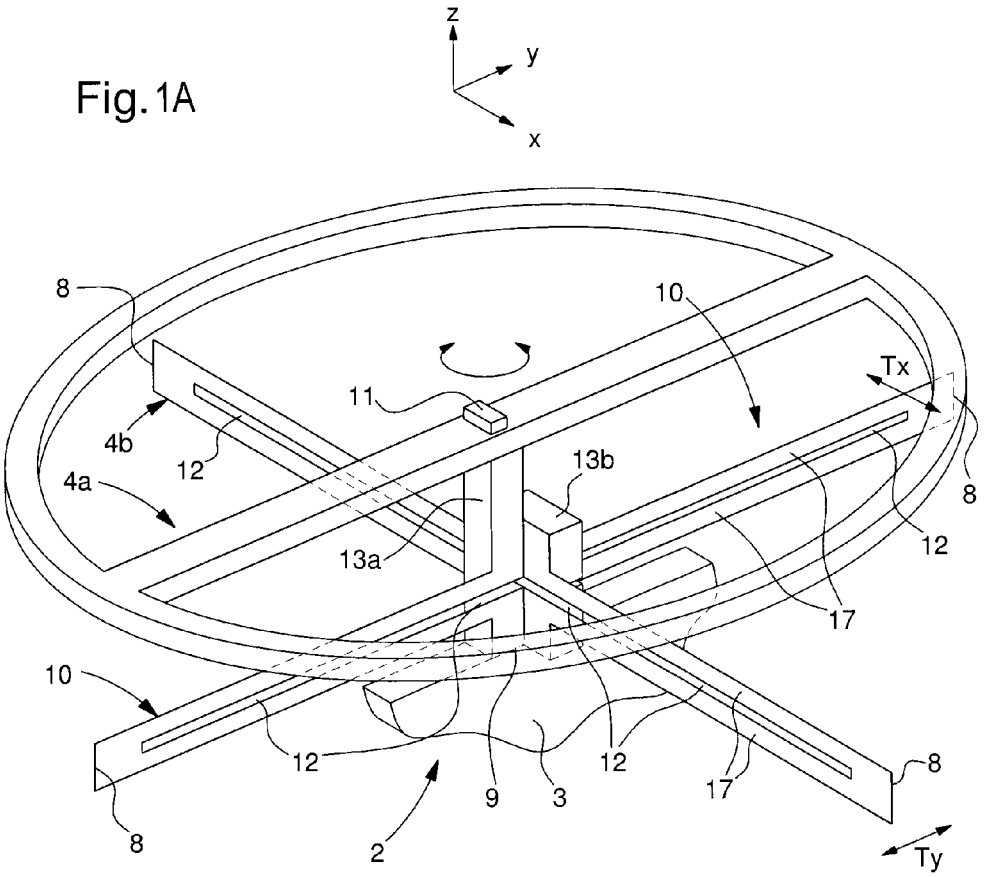
FIG. 1A is a schematic perspective view of a device for elastic guidance in rotation for a timepiece mechanism, according to an embodiment of the invention.

Referring to the Figures, a device for elastic guidance in rotation 2 comprises construction blades 4*a*, 4*b* configured to be assembled and fixed together in order to form the device for elastic guidance in rotation. Each construction blade includes at least one slot 12 separating the construction blade into at least two parts which are coupled elastically and moveable. The device for elastic guidance allows rotation about an axis of rotation Z, of an element 1 (for example a balance wheel or the pallets) relative to another element 3 (for example a frame), the elements fixed to the device for elastic guidance at the anchorage zones 9, 11 respectively. The anchorage zones 9, 11 are disposed at opposite axial ends of the device for flexible guidance, the axial direction being defined by the axis of rotation Z.

The construction blades 4*a*, 4*b* comprise an assembly fixing part 6, and a functional part 10 extending from the assembly fixing part as far as a free end 8, the assembly fixing part 6 and the functional part 10 being separated by at least one slot 12 in at least two extensions 17 which are elastically connected and extend in a radial direction X, Y transverse to the axial direction Z.

Figure 1B:
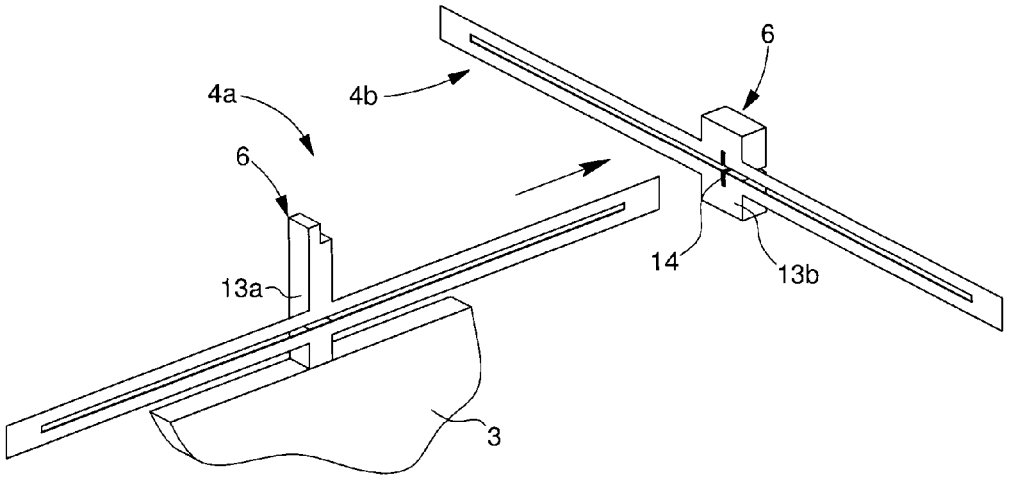
FIG. 1B is a view of the embodiment of FIG. 1A in the course of assembly.
Figure 1C:
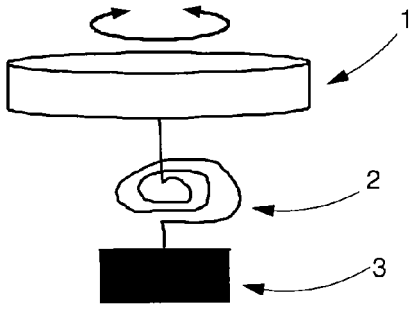
FIG. 1C is a schematic drawing illustrating a function of the guidance device in a mechanism.
Figure 2A:
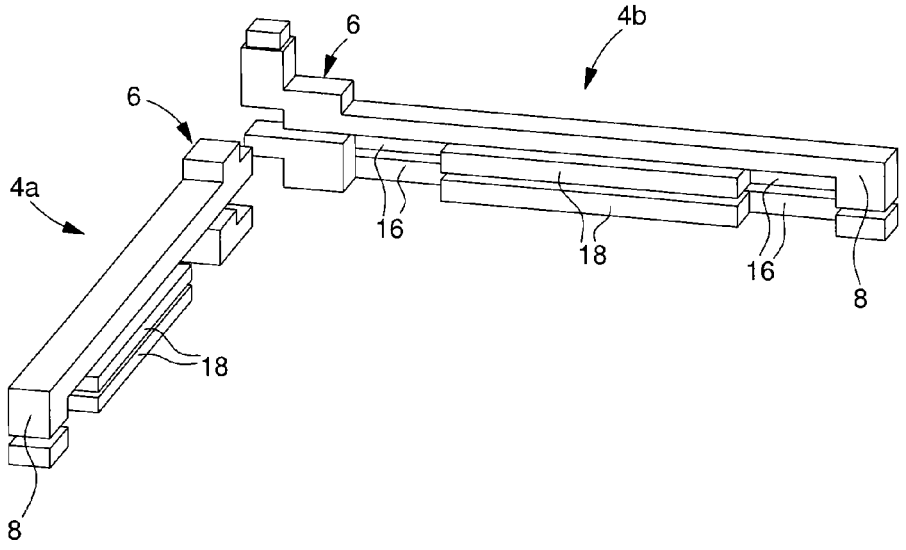
FIGS. 2A, 2B are schematic exploded perspective views of a device for elastic guidance in rotation for a timepiece mechanism, according to a second embodiment of the invention.
Figure 2B:
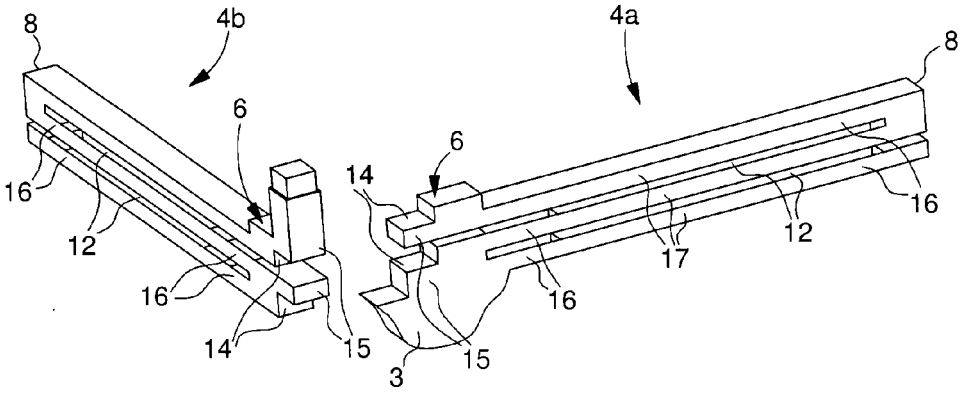
Figure 2C:
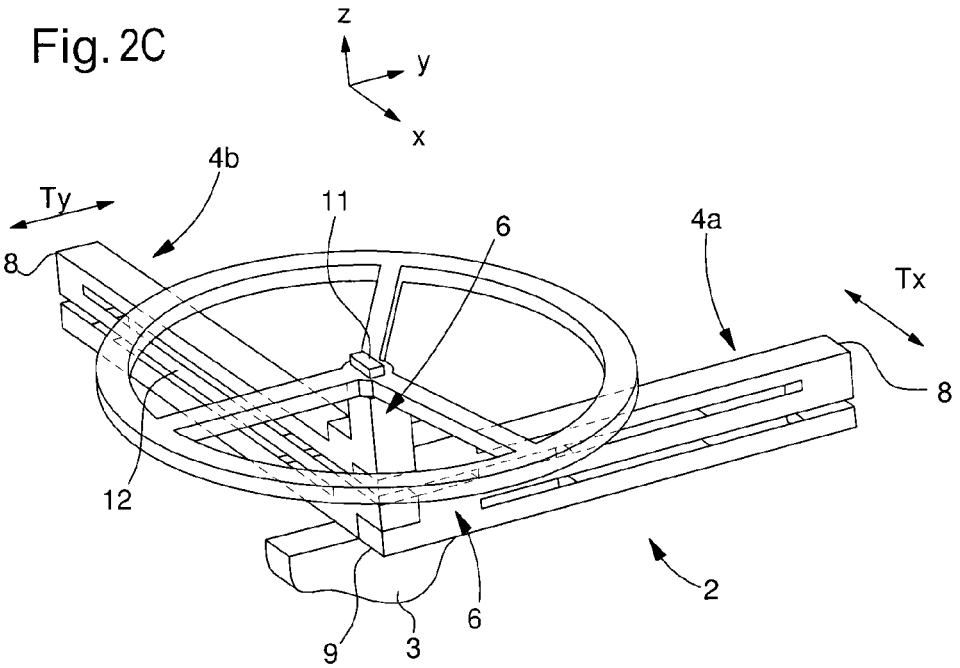
FIG. 2C is a perspective view of the assembled device of FIG. 2A.
Figure 3:
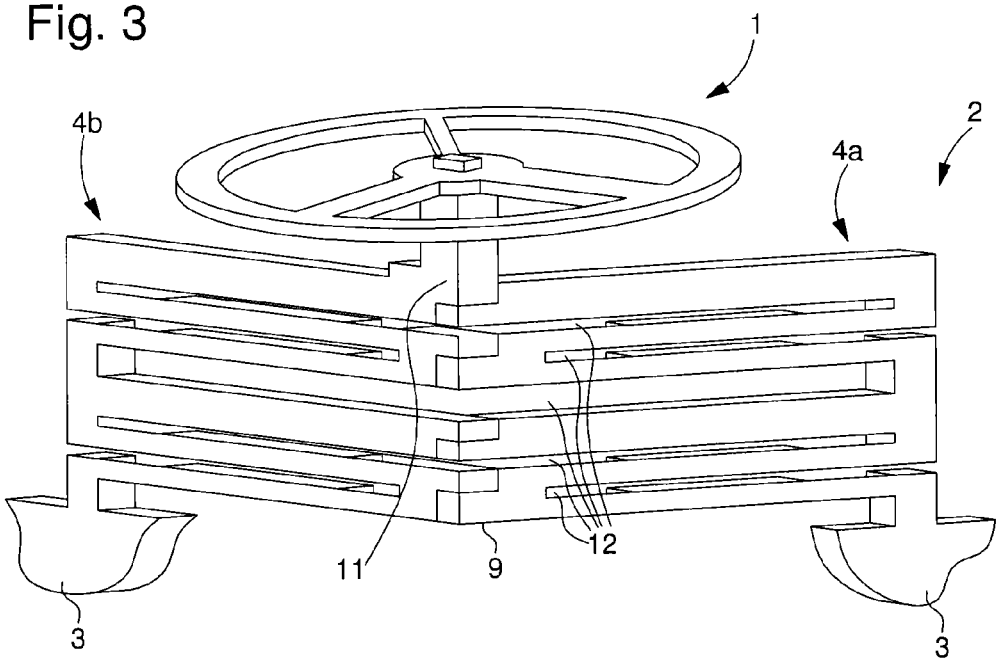
FIG. 3 is a schematic perspective view of a device for elastic guidance in rotation for a timepiece mechanism, according to a third embodiment of the invention.

The device can have construction blades with functional parts on both sides of the assembly fixing part 6 as illustrated in FIGS. 1A and 1B, or with a functional part extending only on one side of the assembly fixing part 6 as illustrated in FIGS. 2A to 2C. The assembly fixing part 6 can form a body 13 which in certain embodiments or variants represents the central part of the device encompassing the axis of rotation Z of the device.

In the Figures, the axial direction is represented by the axis Z which is parallel to the axis of rotation of the device for elastic guidance in rotation. The radial direction is illustrated by the axes X and Y situated in a plane orthogonal to the orthogonal direction Z. In flexible guidance applications, having great rigidity in the axial direction and great flexibility in rotation is sought.

The assembly fixing part comprises a body 13*a*, 13*b*, the body 13*b* of at least one of the construction blades 4*b* including a cavity or an assembly recess 14, configured for insertion in a radial direction of one part of the other construction blade 4*a* such that, in the assembly fixing part 6, the construction blades 4*a*, 4*b* intersect. This intersection of the assembly fixing parts of the two construction blades 4*a*, 4*b* is very advantageous since it makes it possible to manufacture the construction blades independently in an optimum manner in order to define the thicknesses of the blade whilst having, once assembled, a device for elastic guidance in rotation with great rigidity in the axial direction Z. In fact, each construction blade 4*a*, 4*b* can be formed by known processes of deposition or etching, for example through a photolithographic mask, of silicon or of other materials in an essentially bi-dimensional process. A bi-dimensional process makes it possible to obtain precise thicknesses over the length of the blade and shapes represented by various thicknesses over the length of the blade which are easy to manufacture with great precision via masks defined by simple photolithographic processes. The direction of increase or reduction of the blades can be effected solely according to an elastic displacement direction Tx, Ty orthogonal to the radial direction X, Y, such a process being simple, economical and allowing easy control of the thicknesses in order to obtain blades which are rigid in the axial direction Z but have elasticity which is precise and well controlled with a uniform, robust structure.

The construction blades are formed from a wafer cut out in a block of material, in particular a crystalline material, the sheet being commonly termed "wafer". The block of material can in fact be a block of monocrystalline silicon or a block of another material used in the wafers for integrated circuits or micromechanics industry. Etching of the construction blades is effected in a direction orthogonal to the main plane of the wafer (which is parallel to the cut surface of the wafer). The construction blades are orientated such that the axis of rotation of the flexible guidance, which extends in the axial direction Z, is parallel to the main plane of the construction blades. The properties and elastic characteristics of the construction blades in their elastic displacement direction Tx, Ty are consequently dependent upon the thicknesses in the direction orthogonal to the main plane, these thicknesses being able to be well controlled in economic manufacturing processes.

In one embodiment, the wafer can comprise two layers of equal or different thicknesses, welded or glued together, this making it possible, in an etching process, to obtain precise thicknesses corresponding to the thicknesses of one or other of the layers. In fact, the interface between the two layers defines a threshold which makes it possible to stop precisely the reduction of material at the level of the interface during the etching process. The precision in formation of the thicknesses is an advantage for controlling well the elastic properties and the resistance of the construction blades. In this embodiment, it is possible to manufacture, economically and with precision, construction blades with two levels, having parts with a thickness corresponding to the thickness of one or other of the layers and parts with a thickness corresponding to the thickness of the two layers.

The construction blades can also comprise sacrificial structures which assist assembly.

In the embodiment illustrated in FIGS. 1B and 1A, one of the construction blades 4*b* includes a slot 14 forming the assembly cavity, the functional part 10 of the other blade 4*a* being inserted in the slot 14 until the body 13*a* of the latter abuts against the body 13*b* of the construction blade 4*b*. In the illustrated variant, each construction blade 4*a*, 4*b* comprises a functional part 10 which extends in a radial direction on both sides of the body 13*a*, 13*b*, this body forming a central part of rotation relative to the ends 8 of the blades. In this embodiment, the ends 8 of the blades are free. However, in some variants, the ends 8 can be fixed to a balance wheel or to a frame or to another structure.

The body 13*a*, 13*b* is fixed in the anchorage zones 9, 11 on both sides of the slot 12 to two elements, one being moveable relative to the other. For example, one of the anchorage zones 9 can be fixed to a frame, and the other of the anchorage zones to an element which pivots relative to the frame. In this embodiment, the device can serve as spring and support for an oscillator or element pivoting about the axis of rotation Z, without requiring another pivot or support for the pivoting element. The device can however be used in other configurations, for example the central body 13 can be fixed to two moveable elements at the anchorage zones 9, 11, the ends 8 of the blades being coupled to a frame.

Referring to the embodiment illustrated in FIGS. 2A to 2C, the construction blades 4*a*, 4*b* each comprise only one functional extension part 10 which extends from the assembly fixing part 6 forming a "V" configuration. The axial ends 9, 11 of the assembly fixing part 6 can be coupled to elements or structures which are moveable relative to each other. The assembly fixing part 6 of each of the construction blades 4*a*, 4*b* comprises an assembly cavity 14 and an assembly extension 15 which intersect and which fit together in order to be locked together. The two construction blades can be locked together by a welding or soldering process, by an adhesive, or by a clamp or other means of mechanical clipping. The construction blades 4*a*, 4*b* can include a plurality of slots 12 spaced in the axial direction Z, as illustrated in FIG. 2C, FIG. 3 and FIGS. 4A to 4C in order to form a plurality of functional extension parts having elastic parts 16. This makes it possible to increase the amplitude of the angle of elastic rotation between the anchor zones 9, 11.

Figure 4A:
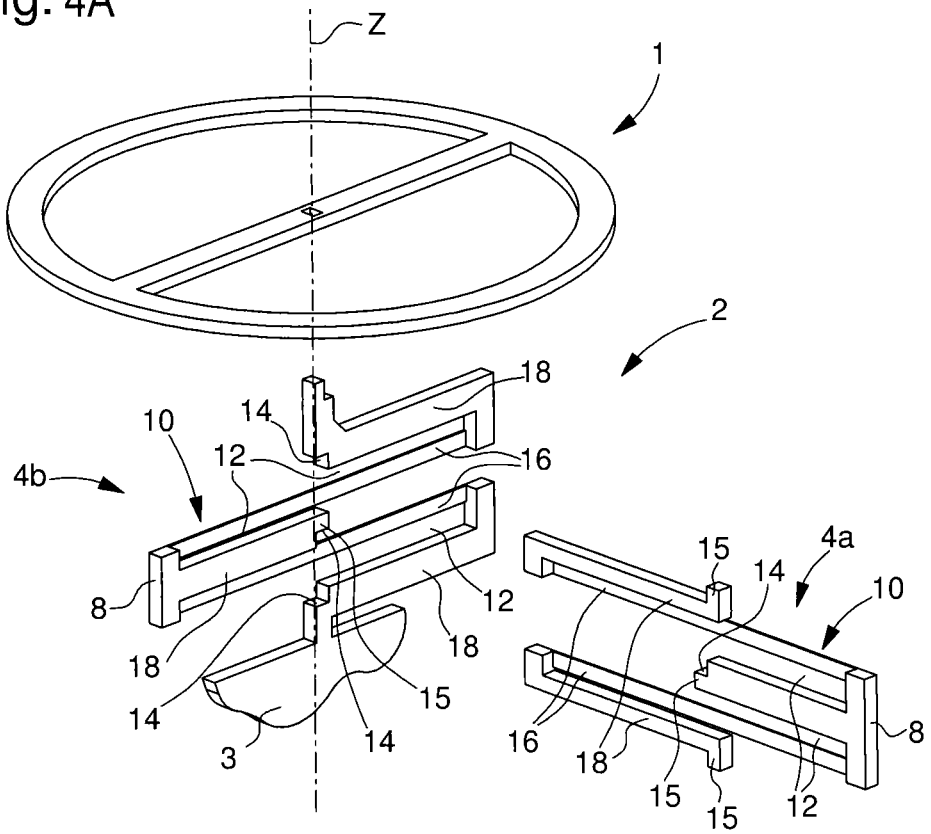
FIG. 4A is an exploded perspective view of a device for elastic guidance in rotation for a timepiece mechanism, according to a fourth embodiment of the invention.
Figure 4B:
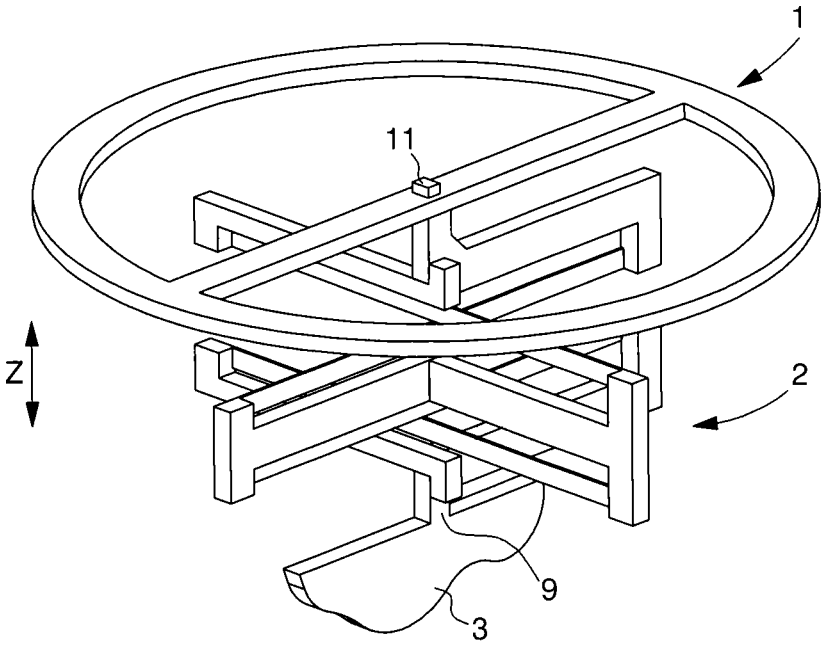
FIGS. 4B and 4C are perspective views of the fourth embodiment in neutral and pivoted positions respectively.
Figure 4C:
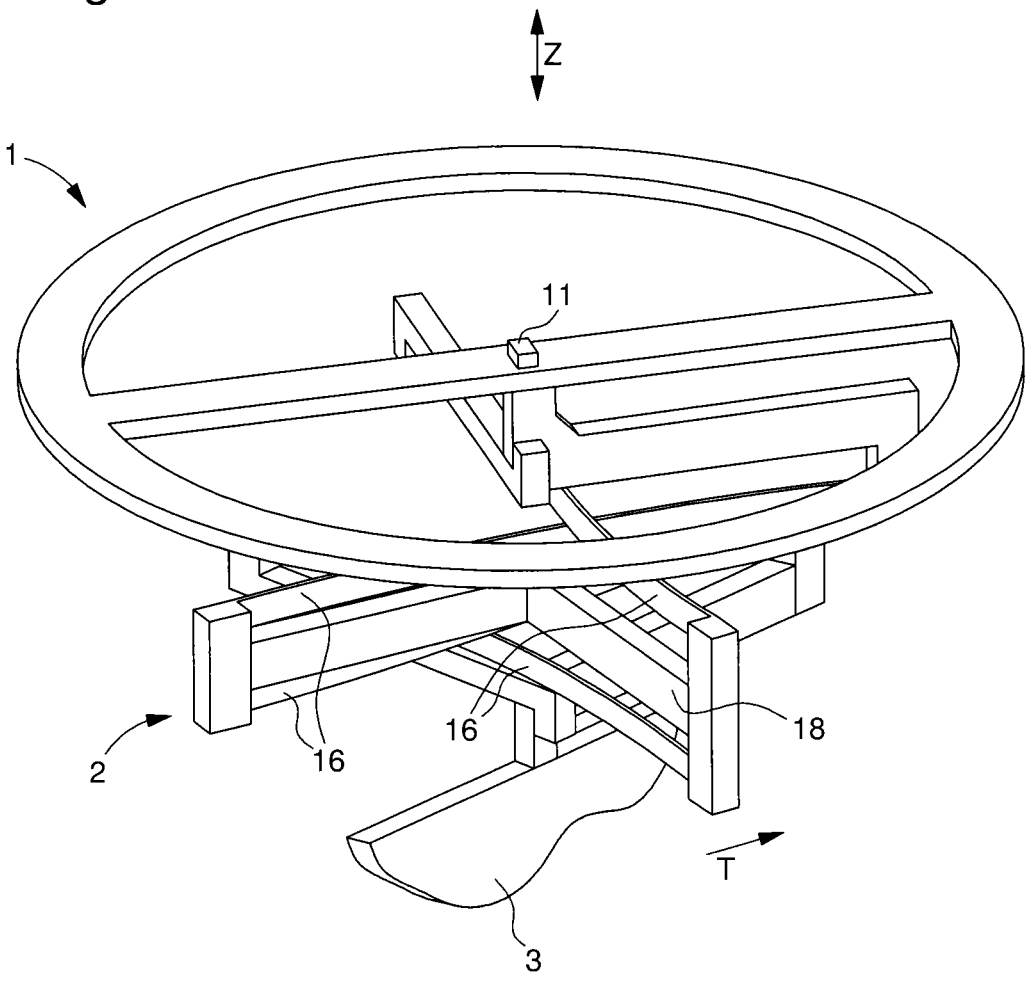

The construction blades can have complex shapes whilst being easy to manufacture with precision, by varying the thickness in the etching, respectively deposition, direction (direction T), for example as illustrated in FIGS. 2A to 2C with a functional part comprising elastic portions 16 and a rigid portion 18 interposed between the elastic portions and also a radial slot 12 or several radial slots 12. Another example is illustrated in FIGS. 4A to 4C where the blades comprise elastic portions 16 which extend essentially over the entire length of the blade and are connected at their ends 8 to rigid portions 18, the rigid portions extending from the ends 8 to the pivot axis Z. The elastic portions have thinner walls than the walls of the rigid portions.

The elasticity in the direction of rotation (direction T) of the construction blades can be controlled by varying the length of the rigid portions 18, respectively the length of the elastic portions 16, and also by varying the number of radial extensions, respectively of slots, stacked in the axial direction. This likewise makes it possible to control the distribution of the masses and finally not only the spring constant but likewise the resonance frequencies, in particular of the first order of the elastic system.

One advantage of the invention is that the construction blades can be manufactured as structured pieces and in two levels: a first level which can be very fine, for example of the order of 10 μm in order to fashion the flexible blades, and a thicker level, for example of the order of magnitude of 400 μm, making it possible to produce rigid mountings, this giving essentially a planar part structured with two levels with slots. The assembly of two blades by intersection and fitting together is also very simple to effect.

Flexible guidance according to the invention can be used for various applications, for example as guidance of the pallets in a watch, or as guidance of the balance wheel in a watch, the balance wheel no longer having a pivoting frictional axis nor a spiral, these two elements being replaced by the flexible guidance.

REFERENCE LIST

1 element (e.g. balance wheel)
2 device for elastic guidance in rotation
3 element (e.g. frame)
4*a*, 4*b* construction blades
6 assembly fixing part
13 body
14 assembly cavity
15 assembly extension
8 free end
10 functional part
17 radial extension
16 elastic portion
18 rigid portion
12 radial slot
9, 11 anchorage zones
Z axial direction/axis of rotation
X, Y radial directions
X-Y radial plane
Z-X, Z-Y axial plane
Tx, Ty directions of elastic displacement

What is claimed is:

1. A device for elastic guidance in rotation for a timepiece mechanism allowing rotation of one element relative to another element about an axis of rotation Z defining an axial direction, comprising construction blades, each construction blade comprises an assembly fixing part comprising a body and a functional part extending from the body as far as one end, the assembly fixing part and the functional part being separated by at least one slot in at least two extensions which are elastically connected and extend in a radial direction transverse to the axial direction, said device comprising furthermore anchorage zones which are disposed at opposite axial ends of the flexible guidance device, and configured to be fixed to said elements, said device being wherein the construction blades are formed from a wafer of material defining a main plane, the construction blades being orientated such that the axis of rotation of the flexible guidance Z is parallel to the main plane of the construction blades.

2. The device according to claim 1, wherein said wafer is made of a crystalline material.

3. The device according to claim 1, wherein said wafer comprises two layers of equal or different thicknesses, welded or glued together, the construction blade having parts with a thickness corresponding to the thickness of one of the layers and parts with a thickness corresponding to the thickness of the two layers.

4. The device according to claim 1, wherein the body represents a central part of the device encompassing an axis of rotation of the device.

5. The device according to claim 1, wherein the body of at least one of the construction blades comprises an assembly cavity configured for insertion, in a radial direction, of a part of the other construction blade such that the assembly fixing part of the construction blades intersect.

6. The device according to claim 1, wherein one of the construction blades includes a slot forming the assembly cavity, the functional part of the other blade being inserted in the slot until the body of the latter abuts against the body of the former.

7. The device according to claim 1, wherein each construction blade is formed by deposition and/or etching processes in an essentially bi-dimensional process.

8. The device according to claim 1, wherein the construction blades are produced in a material based on silicon.

9. The device according to claim 1, wherein each construction blade comprises a functional part which extends in a radial direction on both sides of the body, this body forming a central part for rotation relative to the ends of the blades.

10. The device according to claim 1, wherein the ends of the blades are free.

11. The device according to claim 1, wherein it is configured as a spring and support for an oscillator or an element pivoting about the axis of rotation Z, without requiring another pivot or support for the pivoting element.

12. The device according to claim 1, wherein each of the construction blades comprises only one functional part which extends from the assembly fixing part, forming a "V" configuration.

13. The device according to claim 1, wherein the construction blades include a plurality of slots spaced in the axial direction in order to form a plurality of functional extensions which have elastic portions.

14. The device according to claim 1, wherein each construction blade forms a monolithic structure.

15. The device according to claim 1, said device being formed from two construction blades.

16. The device according to claim 1, wherein the assembly fixing part of each of the construction blades comprises a cavity or an assembly recess and an assembly extension which intersect and which fit together in a radial direction in order to be locked together.

17. A watch movement comprising a device for elastic guidance in rotation for a timepiece mechanism allowing rotation of one element relative to another element about an axis of rotation Z defining an axial direction, comprising construction blades, each construction blade comprises an assembly fixing part comprising a body and a functional part extending from the body as far as one end, the assembly fixing part and the functional part being separated by at least one slot in at least two extensions which are elastically connected and extend in a radial direction transverse to the axial direction, said device comprising furthermore anchorage zones which are disposed at opposite axial ends of the flexible guidance device, and configured to be fixed to said elements, said device being wherein the construction blades are formed from a sheet of material defining a main plane, the construction blades being orientated such that the axis of rotation of the flexible guidance Z is parallel to the main plane of the construction blades.

* * * * *